United States Patent [19]

Pengelly

[11] Patent Number: 4,735,525

[45] Date of Patent: Apr. 5, 1988

[54] IRRIGATION CHANNEL GATES

[76] Inventor: David S. Pengelly, P.O. Box 202, Keith, Australia, 5267

[21] Appl. No.: 903,417

[22] Filed: Sep. 4, 1986

[51] Int. Cl.[4] ..... E02B 7/40

[52] U.S. Cl. ..... 405/99; 405/87; 405/91

[58] Field of Search ..... 405/84, 87, 91, 95–102, 405/85; 49/68

[56] References Cited

U.S. PATENT DOCUMENTS

| | | | |
|---|---|---|---|
| 89,894 | 6/1869 | Mc Farlane . | |
| 303,807 | 8/1884 | Coiseau | 405/85 |
| 535,153 | 5/1895 | Witcher . | |
| 610,548 | 9/1898 | Manny | 405/85 |
| 674,629 | 5/1901 | Guthrie | 405/85 |
| 1,645,913 | 8/1926 | Mc Candless . | |
| 2,584,364 | 8/1949 | Osborne . | |
| 2,664,713 | 1/1954 | Baker | 405/91 |
| 2,750,871 | 6/1956 | Landgraber et al. | 49/68 X |
| 3,062,278 | 11/1962 | Indorante | 49/68 X |
| 3,091,934 | 12/1961 | Jacobs . | |
| 3,333,423 | 4/1967 | La Cook . | |
| 4,011,686 | 3/1977 | Jett et al. | 49/68 |
| 4,024,717 | 4/1977 | Hudson . | |
| 4,349,296 | 9/1982 | Langeman | 405/99 |

FOREIGN PATENT DOCUMENTS

| | | |
|---|---|---|
| 519347 | 5/1978 | Australia . |

*Primary Examiner*—Dennis L. Taylor

*Attorney, Agent, or Firm*—Oldham, Oldham & Weber Co.

[57] ABSTRACT

An irrigation channel gate uses flexible members which once released use the power of water flow to open and shut the gate. When flow in the channel is desired both an upstream gate and downstream gate are open. To stop flow the upstream gate is released. To reset the gates the down stream gate is closed and the upstream gate is opened. Opening of the downstream gate permits flow again. The gates essentially comprise a main member hinged on a horizontal axis at the base of the channel and flexible side pieces to connect the main member to a central frame.

12 Claims, 9 Drawing Sheets

IRRIGATION CHANNEL GATES

BRIEF SUMMARY OF THE INVENTION

This invention relates to water control gates and more particularly to gates suitable for irrigation channels and to controlling mechanisms therefore, and also the methods of operating such gates.

Such gates may be of a type used along irrigation channels or may be of a type used along the sides of irrigation channels to allow water to flow into bays along the channel and extending therefrom and such gates may have local or remote control.

There have been proposed many forms of irrigation channel gates but the majority of these have utilised a rigid closure member which may be hinged or lifted for allowing water flow and then closed or placed down again to stop water flow. There is a problem however that if solid material such as stones, pebbles, sticks or the like are in the gateway when the gate is shut, then the solid gate member may jam not fully shut and considerable leakage through the gate can occur.

A further problem exists that with fluid flow in a channel, considerable momentum exists and if the gate is shut quickly then the water hammer effect may be sufficient to distort the gate so that it will no longer seal.

There have been proposed a two part irrigation gate comprising an upstream part and a downstream part in which the gate is set by placing the upstream gate which is hinged along its upper edge in an open position and the downstream gate, which is hinged on its lower edge in a closed position, and when water flow is required the downstream gate is allowed to swing down to open to permit water flow but when it is desired to stop water flow, the upstream gate is allowed to swing down and shut thereby cutting off water flow. Resetting of such gates may be done manually. This system does have the problem as discussed above of water hammer damage and in a quite short time if strong flow rates are occurring through the gate, the gate can become so distorted as not to be useful.

There has also been provided an irrigation gate comprising a flexible canvas membrane, sealed along the sides of the channel and when it is desired to stop fluid flow, the member is raised until its upper edge becomes above the fluid level. In this way fluid flow is stopped gradually and the flexible sheet will conform over obstructions and provide a good seal.

This flexible gate system does have the problem however that considerable force is required to cut off water flow in a channel and hence it is normally used in situations where flow in the channel can be cut off completely when all the irrigation gates are reset shut and then the main channel is filled again and then one by one the various gates can be released to allow water flow out of the channel into the various bays.

The present invention is directed towards a system which will overcome the problems of the various forms of the prior art and will provide a readily usable irrigation gate system.

In one form therefore the invention is said to reside in an irrigation channel gate comprising a central frame adapted to be positioned across an irrigation channel and to sealably engage the walls and base thereof, gate members sealably engaged to the central frame and extending upstream and downstream of the frame respectively and in respect of gate member support means associated with each gate member.

In a preferred form each gate member is adapted to be able to fold up substantially against the frame to form a flow preventing position and to unfold to form a flow permitting position..

In one preferred embodiment water flow in the irrigation channel may provide water pressure to cause the upstream gate member to move from a flow permitting position to a flow prevention position.

In a similar manner the water pressure head in the irrigation channel may be the means for causing the downstream gate member to move from the flow preventing position to the flow permitting position It will be seen that by this invention there is provided an irrigation channel gate having a dual gate system each of which readily folds up from the open position to the closed position. In use the water can flow through the gate when both of the gate members are in the open position with the upstream gate held open and when it is desired to shut off fluid flow the upstream gate is released so that it may move to a folded closed position and prevent fluid flow.

Once fluid flow has stopped, the downstream membrane may be reset to a closed position and locked in that position and then the upstream gate may be reopened ready for the next flow of fluid. The next flow of fluid may then be started by releasing the downstream gate member from its closed position to its open position.

In a further preferred form of the invention therefore, respective gate restraining means may be provided to engage the gate member support means to restrain the gate member either in an open position or a closed position.

In a preferred form the gate restraining means for the downstream gate may be adapted to hold the gate support means and hence the gate members in the flow preventing position.

Similarly in a preferred form the gate restraining means for the upstream gate may be adapted to hold the gate support means and hence the gate members in the flow permitting position.

There may be further provided respective solenoid means to restrain the respective gate restraining means in the positions as described above.

Alternatively the gate restraining means may include a release mechanism comprising a permanent magnet acting on a catch bar to hold the catch bar in a locked position and electromagnet about the permanent magnet but to provide opposite polarities to the permanent magnet such that upon activation of the electromagnet the permanent magnet may release the catch bars by neutralisation of the magnetic field.

In a preferred form both the upstream and downstream gate members may comprise a plurality of plates sealably joined together by impervious flexible sheet materials such that they can fold up to form a flow preventing position and unfold to form a flow permitting position as discussed above. Alternatively, the gate support means for both the upstream and downstream gate members may comprise a series of frame members having stretched therebetween impervious flexible sheet material to provide the gate member.

Alternatively the gate support means for the upstream gate may comprise a series of frame members having stretched therebetween an impervious flexible sheet material to provide the gate member and the gate support means for a downstream gate, may comprise a single transverse bar fastened to an impervious flexible sheet material to provide the gate members.

The series of frame members may comprise a base frame hinged to a base of the central frame and two side frames, one to each side of the base frame and hinged to the central frame, with the side frames adapted to swing inward and the base frame adapted to swing upward to fold as discussed above.

There may be further included a link arm between the side frames and the base frame to assist with folding of the flexible sheet material.

In one preferred form, there may be provided radio control means to enable remote opening and closing of the irrigation channel gate. In such a situation a water level detector may be placed at a remote position in the bay from the gate and when water level reaches a desired level at that position then a radio signal could be sent back to the gate to switch that gate to close it and a further signal sent to the gate controlling the next channel to open that gate.

It will be noted that by this invention the use of membrane covered frames or membrane supported panel means that the water hammer will not effect the sealing of the gate.

As discussed above the means to hold the respective gates open and closed may be made by any form of latch means but more specifically the latch means may be of a quick release form whereby a pulse or electric current may activate a release mechanism. An alternative form may have the release mechanism supported by a spring loaded mechanism with release occurring upon removal of the latch means by an electromagnet.

In a further form the latching may be by means of a permanent magnet holding a release catch in a rest position but with the permanent magnet wound with an electromagnetic coil of the opposite polarity. Upon activation of the coil by a brief pulse of low voltage the magnet can be neutralised for long enough for the release catch to be released.

It will be seen that by this invention the problem associated with sticks and stones being incorporated in the gate when it is shut will be obliviated because the membrane or flexible sheet material will be sufficiently flexible to go around an obstacle and in the case of the upstream gate lifting to close the actual speed of closure is slow enough to prevent water hammer and to allow any obstacles which may be in the path of the gate during its closing to move before the gate closes.

The material of the flexible material part of the gate may be a suitable plasticized cloth or canvas with preferably formation in the plasticizing to make the cloth ultraviolet resistant. Alternatively as discussed above the gate may be comprised of a series of panels and the flexible sheet material between the various panels to permit folding and these panels may be of steel, wood, fibreglass or any other suitable material.

It may be desirable that in some cases not a complete gate system as discussed above may be necessary and hence in a further form of the invention, the invention may be said to reside in an irrigation gate comprising a frame adapted to be suitably engaged in an irrigation channel, a membrane suitably engaged with the frame and adapted to extend either upstream or downstream from the gate and membrane support frames hinged to the frame and adapted to support the membrane such that in a first position fluid flow may occur through the gate and in a second position the fluid flow may be prevented from occurring through the gate and means to support the membrane support frames in at least one of their respective positions.

In a further form the invention may be said to reside in a method of controlling the flow of water in an irrigation channel by means of a gate, the gate comprising an upstream gate member and a downstream gate member, the method comprising the steps of opening the upstream gate member and closing the downstream gate member to close off the flow of water, opening the downstream gate member to allow flow of water through the gate and closing the upstream gate member to shut off water flow through the gate when desired.

In a further embodiment, the upstream gate member may be caused to be closed by the releasing of supports holding the gate open and water flow through the gate providing the force for closing the gate.

Similarly the force for opening the downstream gate member may be provided by the head of water in the irrigation channel such that upon releasing restraining means for the downstream gate member the gate may be opened.

In a further preferred embodiment, a radio control signal may be provided in response to a switch off signal actuated at a remote position from the gate to actuate the closing of the upstream gate member.

DETAILED DESCRIPTION

This then generally describes the present invention, however to provide a clearer understanding of the scope of the invention reference will now be made to the accompanying illustrations which show various embodiments of the invention but it is to be realised that as discussed above other arrangement of frames may be used to support the various gate portions to provide an irrigation channel gate having desirable features.

IN THE DRAWINGS

FIG. 9 shows a cross section of the gate controlling mechanism of the embodiment of FIG. 6.

Now looking at a preferred embodiment of the invention with reference to the FIGS. 1 to 5 it will be seen that the irrigation gate according to this invention comprises a central frame 1 having an upper cross bar 2. An upstream gate member generally shown 3 and a downstream gate member generally shown 4.

Figure 4:
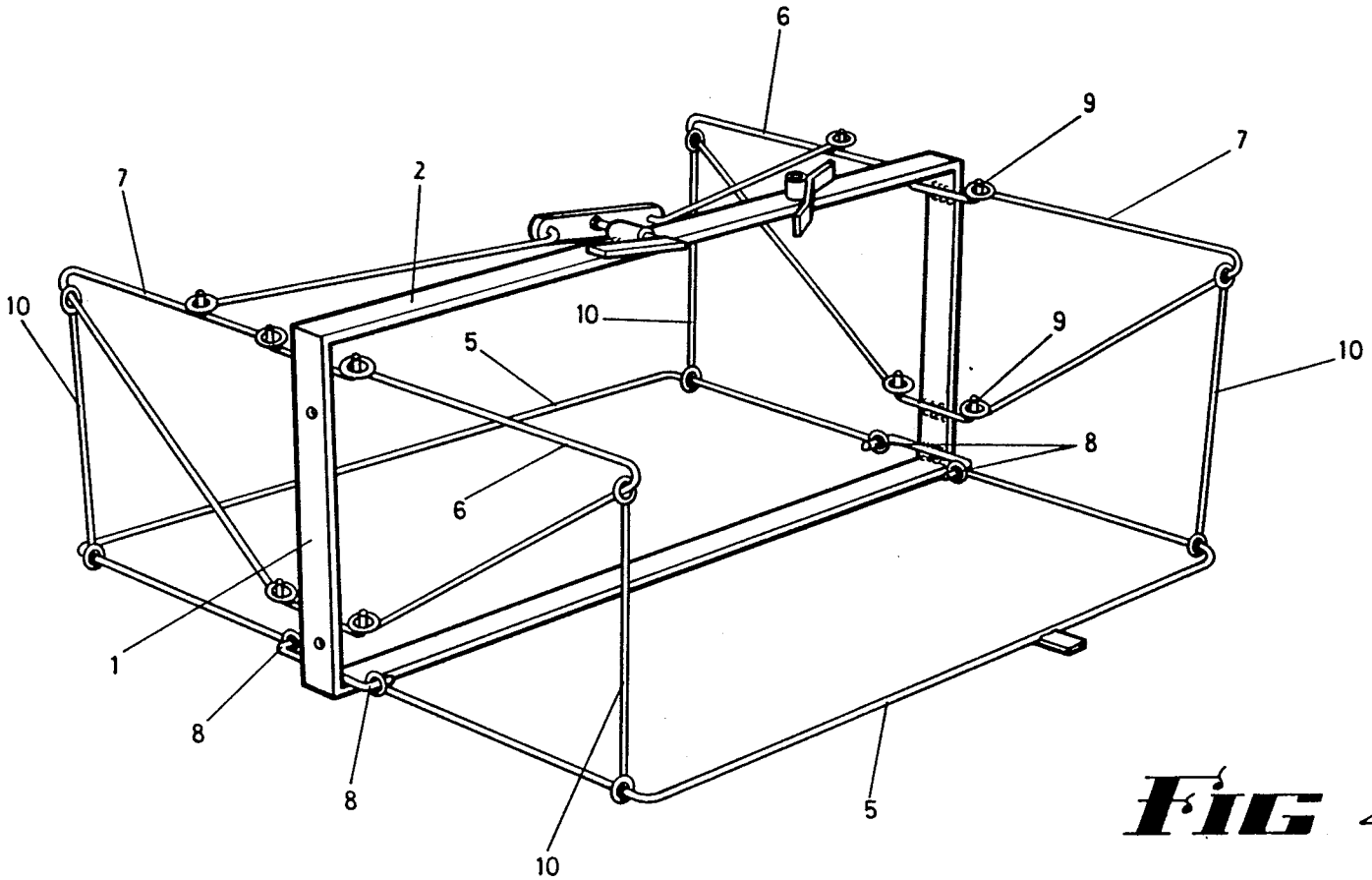
FIG. 4 shows a stylized view of the frames of this embodiment of the invention with the gates in the open position.

Now first looking at FIG. 4 and the framework for the upstream and downstream gate members, it will be seen that in each case the series of frameworks comprise a base frame 5 and side frames 6 and 7. The base frame 5 is hinged on a horizontal axis on pivots 8 so that it may fold upwards and the side frames are hinged on a vertical axis on pivots 9 so that these may pivot sideways to fold in. Between the side frame 7 and the base frame 5 are link arms 10 and these are restrained by means not shown to be retained near the vertices of the side frames and the base frame.

It will be noted that as the side frame 7 is folded in, the link arm 10 will cause the base frame to lift so that the frame can be completely shut to close the gate.

Figure 1:
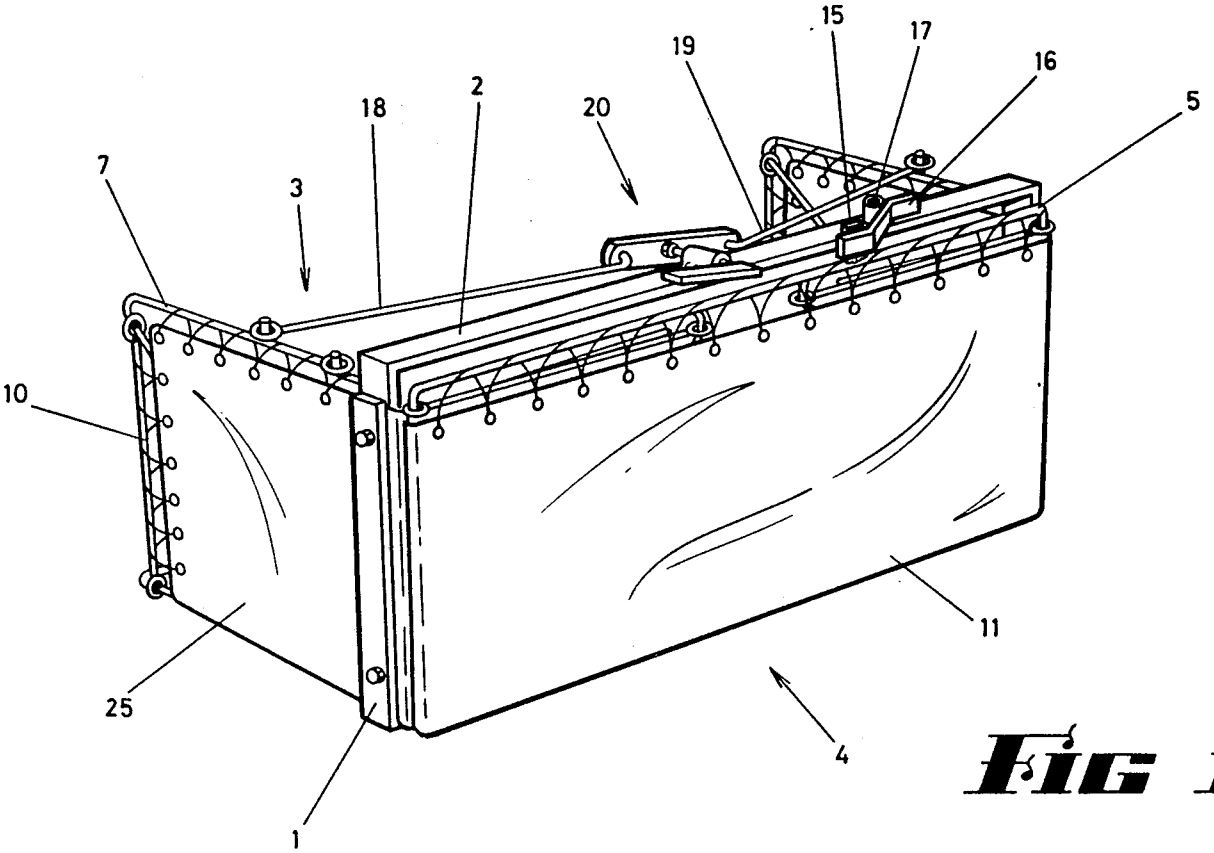
FIG. 1 shows the irrigation gate of the invention in a position ready to be opened to allow water flow.
Figure 2:
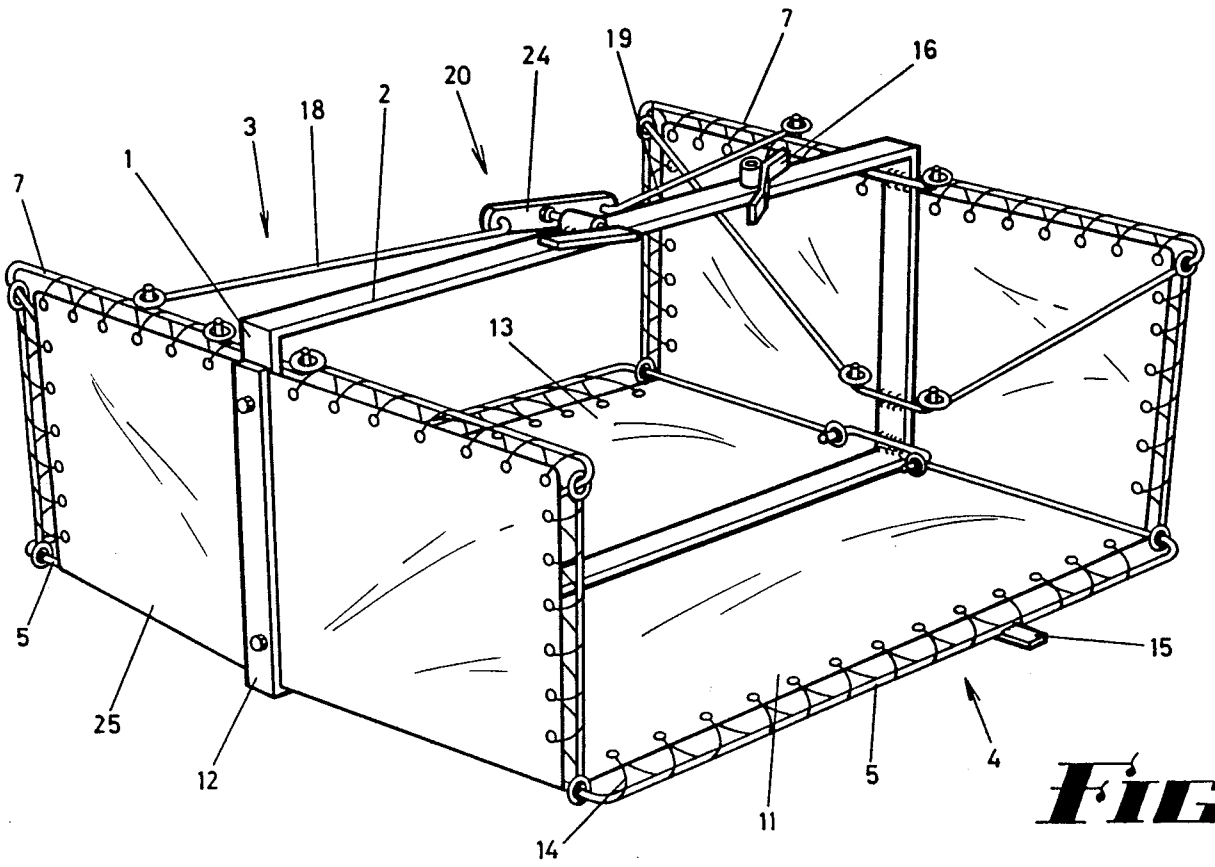
FIG. 2 shows the irrigation gate open for water flow.
Figure 3:
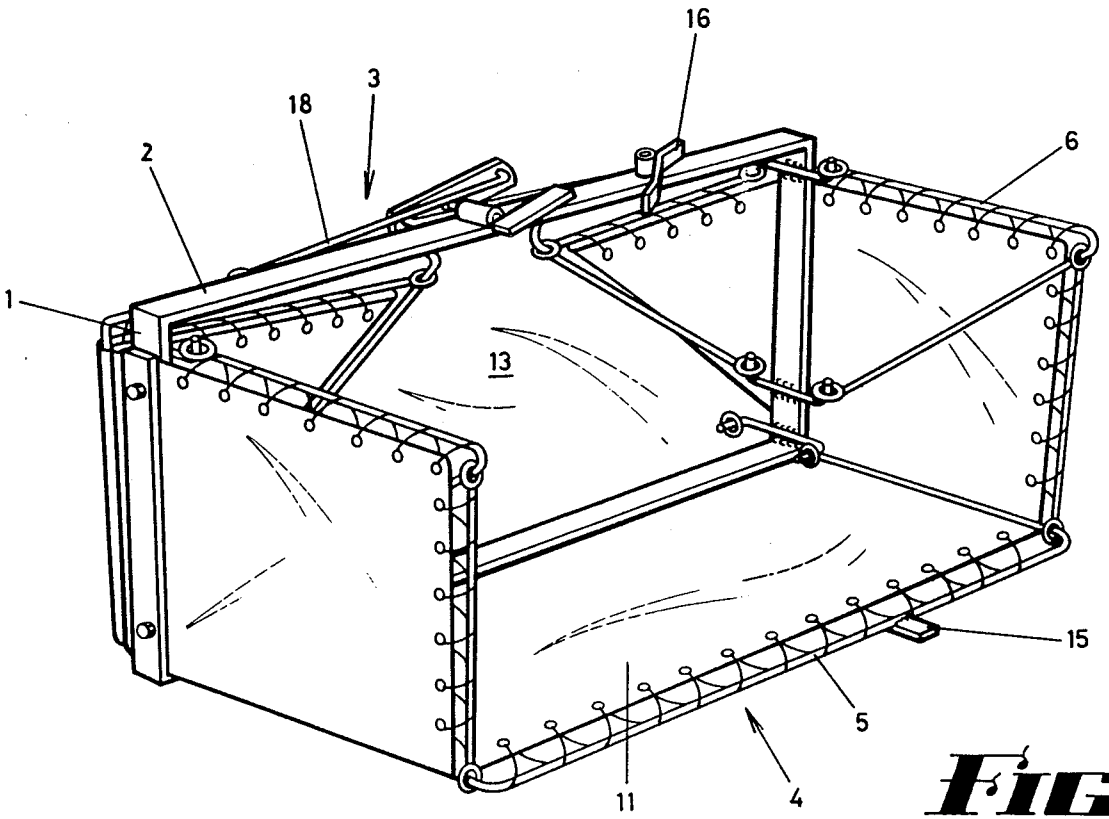
FIG. 3 shows irrigation gate with the gate closed.

FIGS. 1, 2, and 3 show various stages of opening and closing of the irrigation channel gate and in these figures an impervious flexible membrane is stretched over the series of frames. A membrane 11 is placed over the base frame for the downstream gate and then stretched up to the top of the side frames and clamped to the central frame by means of plate 12. Similarly an impervious flexible membrane 13 is stretched over the base frame for the upstream gate and stretched up the side frames and clamped to the central frame. Lacing 14 is provided around each impervious sheet material to lace it to the side frame, link arm and base frame so that it will lift and fold with the frame members.

Now looking at the means for controlling the gates, it will be noted that on the base frame 5 of the downstream gate member 4 a plate 15 extends outwards and it will be seen in FIG. 1 that when the downstream gate is in the closed position the plate 15 is received behind a catch member 16 pivoted on pivot axis 17 mounted on the upper bar 2. The catch member 16 is held in the position as shown in FIG. 5 by means not shown and when it is desired to open the gate, the means not shown is released so that the catch member 16 can swing away and the plate 15 can be released which enables the base frame 5 to swing out and the side gates to swing open to allow water flow.

The means for holding the upstream gates open to allow flow, comprise two link bars 18 and 19 which extend from the top of the side frames 7 to a gate controller generally shown 20.

The gate controller 20 comprises a horizontal transverse axis 21 in a bush 22 welded to the upper plate 2 and having on one end thereto a catch plate 23 and at the other end a crank arm 24.

Figure 5:
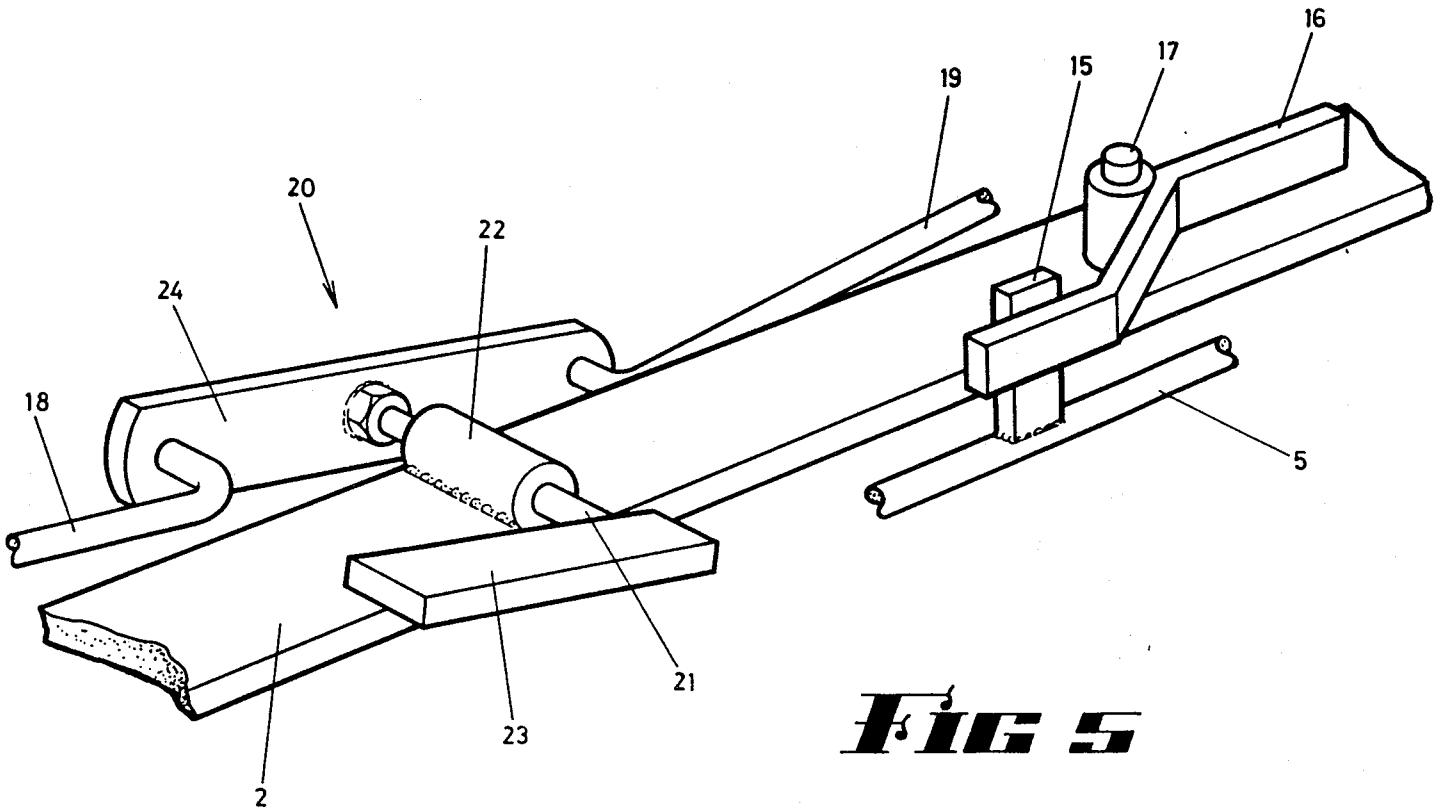
FIG. 5 shows one preferred embodiment of a control arrangement mounted to the central frame for holding the respective gates open and closed as required.

With the crank arm in the position shown in FIG. 5 and catch means not showing holding the catch plate 23 in the position shown in FIG. 5, the side frames and hence the upstream gate is held open but if the catch means not shown is released then the catch plate 23 may pivot upwards and hence the crank arm 24 rotates clockwise and viewed in FIG. 5 which will draw in the link arms 18 and 19 which will pull in the side frames and hence by means of the link arms 10 lift up the base frame 5 of the upstream gate. In fact the process is slightly in the reverse because water pressure on the surface 25 of the side frame 7 of the upstream gate maintains a steady pressure on crank arm 24 through the link arms 18 and 19 and when the catch plate 23 is released then this water pressure on the flexible sheet membrane 25 will cause the gate to close.

Once the water pressure comes underneath the membrane 13 of the upstream gate then water pressure thereof will assist with closing of the gate.

Now looking at the embodiment shown in FIGS. 6 to 10, it will be seen that the upstream gate generally shown as 30 is of a similar construction to that shown in FIGS. 1 to 4 but the downstream gate generally shown 31 is of a different style of construction.

The downstream gate comprises a flexible membrane 32, clamped by means of clamp bar 33 to the central frame 34 and extending out from the base of the central frame 35 and up each side of the central frame 36 and a bar 37 being fastened along the base portion of the membrane 32 by means of lacing 38. Along the bar 37 are loops 39 which engage with hooks 40 on an axle 41, pivoted to the upper part of the central frame 34. A spring 42 is positioned between the upper outer corners of the flexible sheet material 32, to pull the top corners slightly together to assist with folding.

The plate 43 is mounted onto the bar 41 and as shown in FIG. 9, when the downstream gate generally 31 is closed, the hook 40 engages the loop 39 and the plate 43 is retained against electromagnet 44 mounted on a bracket 45 on the upper part of the central frame 46. When it is desired to release the downstream gate, electic current is passed through the electromagnet 47 in opposite polarity to the permanent magnet 44 which releases the plate 43 and hence allows the bar 41 to pivot under the weight of the downstream gate acting on the hook 40 which releases the eye 39 from the hook 40 and enables the bar 37 to fall down and allow flow through the gate.

It will be noted that the upstream gate is held out by means of segmented arms 50 comprising an inner segment 51 and an outer segment 52. The inner segment 51 is pivoted to the outer segment 52 on pivot axis 53 and a stop 54 is placed on the arms so that they may stretch out to be directly in line but no further.

The outer end of the outer segment 52 is connected to the top of the side frame 55 on each side on a pivoting axis 56. The inner end of the inner segment 51 is mounted respectively on pivot axes 57 and pivoting therewith are gear cogs 58 and 59. These cogs 58 and 59 are engaged with each other so that one must rotate with the other.

One of the pivot axes 57 extends through the upper bar of the frame 34 and has mounted thereon a plate 60 which can rotate with the cogs 58 and 59.

Figure 8:
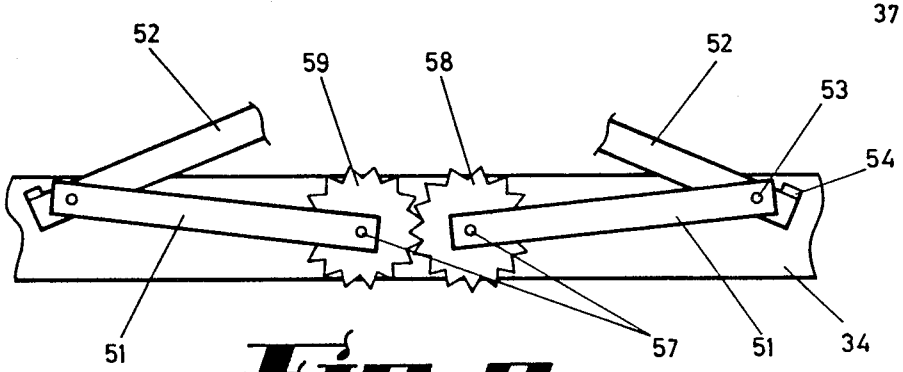

As can be particularly seen in FIG. 9 a permanent magnet 61 is mounted by means of a bracket 62 to the plate 46 and with the upstream gates in the open position the plate 60 is held against the permanent magnet 61. An electromagnet 63 is activated when it is desired to close the gates and this enables the plate 60 to be released from the permanent magnet 61 in the same manner as for the downstream gate which in turn enables the cogs 58 and 59 to be able to rotate and hence the inner and outer segmented arms 51 and 52 to attain the position as shown in FIG. 8.

As for the earlier embodiment the pressure for closing is caused by fluid flow pressing against the surface 64 of the flexible sheet material forming the side walls of the upstream gate.

Figure 6:
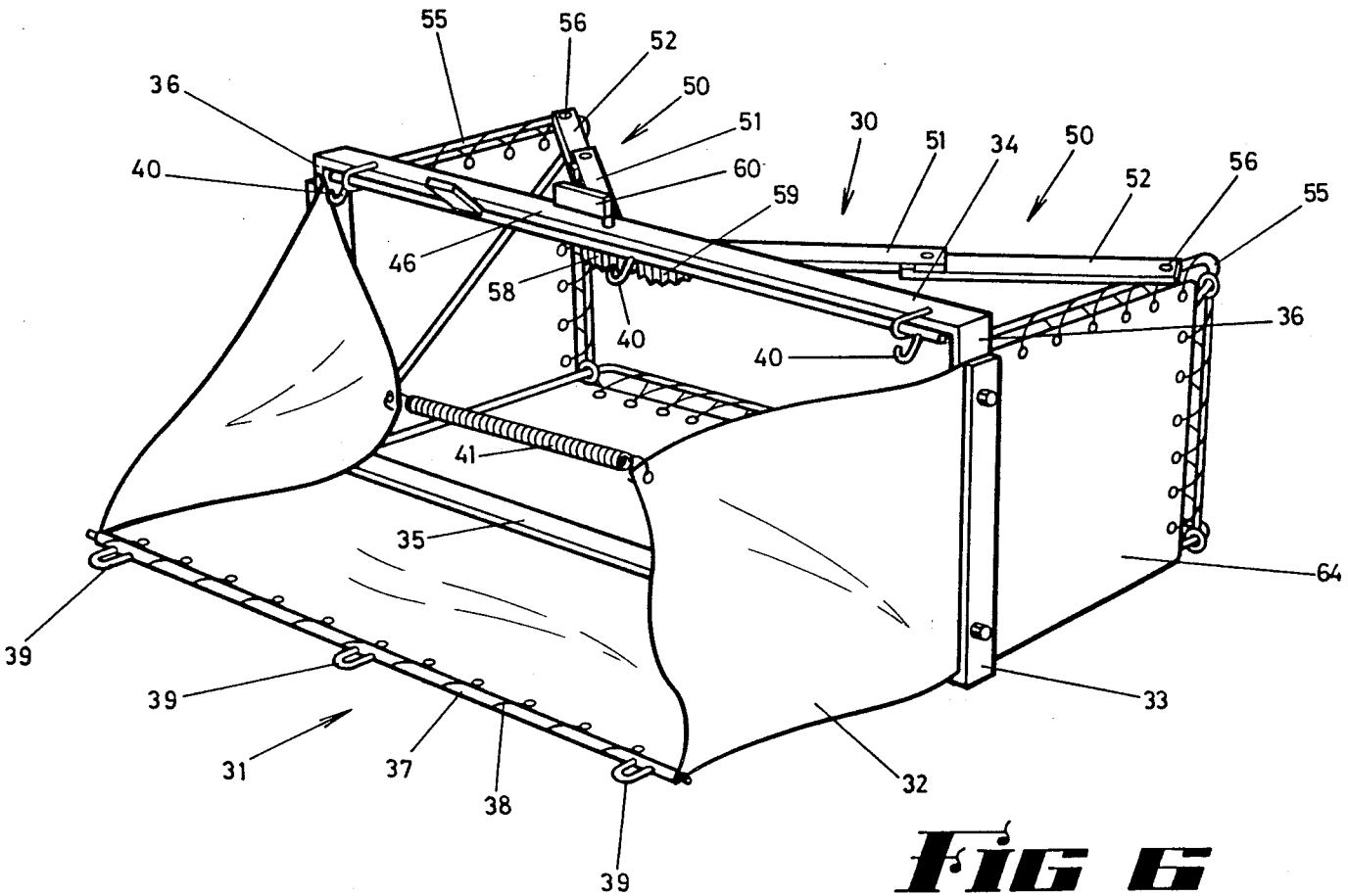
FIG. 6 shows an alternative embodiment of an irrigation gate according to this invention with the gate in the open position.
Figure 6:
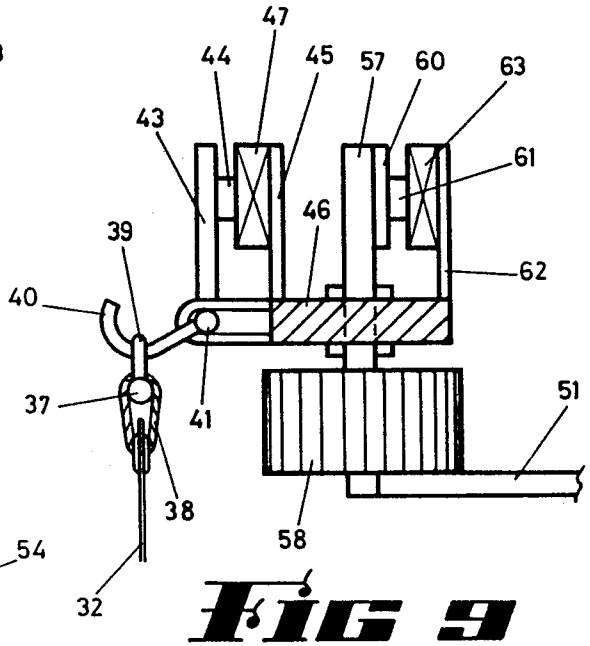
Figure 7:
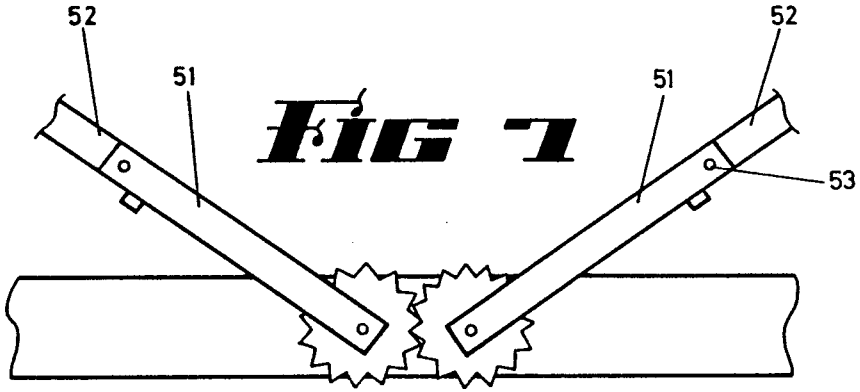
FIG. 7 and FIG. 8 show a preferred method of operating the upstream gate.
Figure 10:
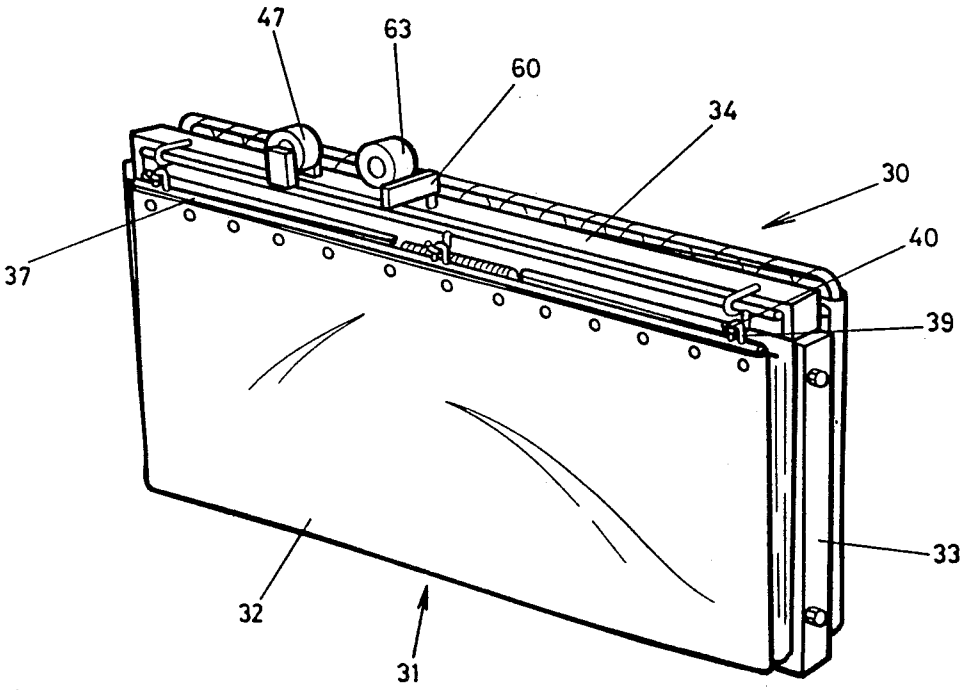
FIG. 10 shows the gate of FIG. 6 with both gates closed.

For clarity purposes the electomagnet 63 and 47 and their associated brackets are not shown in FIG. 6 but FIG. 10 shows these but it will be noted of course that the plate 60 is not engaged against the electromagnet 63 as the gate 30 is in the closed position.

Figure 11:
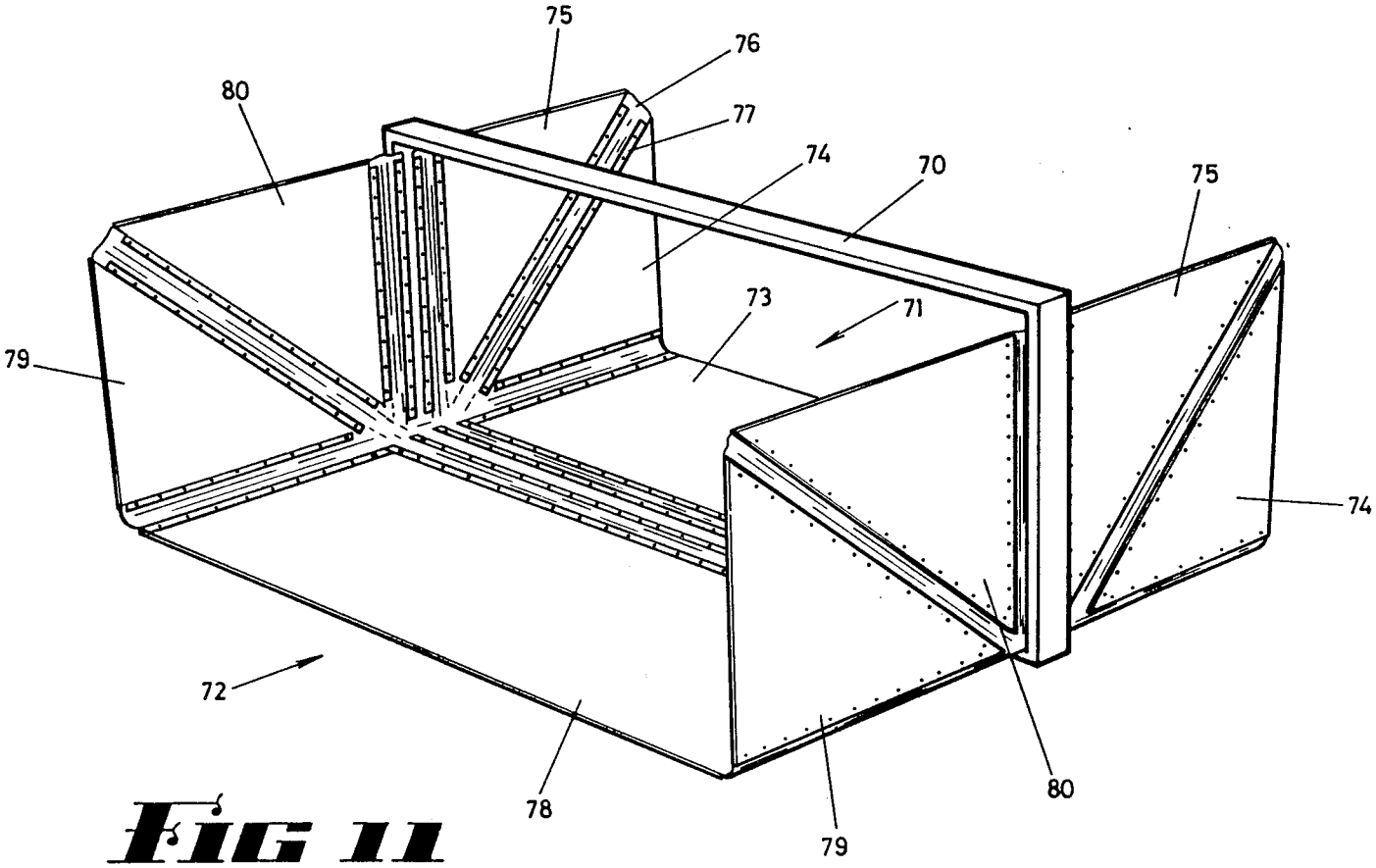
FIG. 11 shows an alternative embodiment of irrigation channel gate using panels and flexible sheet material between the panels.

FIG. 11 shows an alternative embodiment of the gate according to this invention but it will be noted in this drawing that the various controlled mechanisms are not included in this illustration but merely the configuration of the gate members.

A central frame 70 of substantially rectangular construction has attached to it, upper gate 71 and lower gate 72. The upper gate 71 comprises a base plate 73 and triangular side plates 74 and 75. Each side plate is joined to its neighbour by means of flexible material 76 fastened by means of a plate 77 to each of the plates.

Sufficient width of flexible material is provided at each of the joins so that the gate may shut even if sticks or small stones are jammed in the mechanism.

Similarly on the downstream gate 72 there is provided a base plate 78 and triangular side plates 79 and 80.

As pointed out above the control mechanism for such a gate as shown in FIG. 11 is not illustrated but the control mechanism may be of the type shown in FIGS. 1 to 5 or as shown in FIGS. 6 to 10.

With the embodiment shown in FIG. 11 folding is achieved by the triangular side plates 79 and 80 in the case of the downstream gate folding inwards and together, while at the same time lifting the base plate 78.

It will be noted that the irrigation channel gates of the present invention are easily adaptable for radio control of the gate system and such control may be by means of fixed time for each of the gates to be opened or may be by means of some form of liquid level sensor, which sensors when sufficient liquid has reached the far end of an irrigation bay.

The invention is not restricted however to radio control systems and electronic control systems as mechanical trip arrangements may be provided when, for instance, a fixed quantity of water has passed through the gate.

As discussed earlier it will be realised that if a system is desired where only closing of an irrigation channel is required when perhaps opening being performed then only the upstream portion of the irrigation gate for this invention may be necessary.

There are irrigation systems too, in which water is allowed to flow along a channel and to be held up successively by gates and as irrigation in each section is completed then successive gates are opened and in such situations only the downstream portion of the irrigation gate of this invention would be necessary.

I claim:

1. An irrigation channel gate adapted to be positioned across an irrigation channel to control flow of water along the channel, the gate comprising, a central frame to be positioned across the channel, a pair of gate members extending respectively upstream and downstream of the central frame, and a pair of gate member support frames pivotally mounted to the central frame to support respectively the upstream gate member and the downstream gate member, each of the gate members being supported by the frame so that in a first position with the gate member folded against the central frame, flow through the channel is prevented and in a second position flow through the channel is enabled.

2. An irrigation channel gate as in claim 1 further including gate restraining means to engage the gate member support frames to restrain the gate members into either of the first position or the second position, and wherein water pressure acting upon the upstream gate member due to flow of water in the irrigation channel causes the upstream gate member to move from said second position to said first position upon release of the restraining means and water pressure acting upon the downstream gate member causes the downstream gate member to move from said first position to said second position upon release of the restraining means.

3. An irrigation channel gate as in claim 2 wherein the gate restraining means for the downstream gate is adapted to hold said gate member support frame and hence the gate members in the flow preventing position.

4. An irrigation channel gate as in claim 2, wherein the gate restraining means for the upstream gate is adapted to hold said gate member support frame and hence the gate members in the flow permitting position.

5. An irrigation channel gate as in claim 2 further including respective solenoid means to restrain the respective gate restraining means in its desired position.

6. An irrigation channel gate as in claim 5 further including with the gate restraining means, a release mechanism comprising a permanent magnet acting on a catch bar to hold the catch bar in a locked position and an electromagnet about the permanent magnet but to provide opposite polarity to the permanent magnet such that upon activation of the electromagnet the permanent magnet may release the catch bar by neutralisation of the magnetic field.

7. An irrigation channel gate as in claim 1, wherein both the upstream and downstream gate members comprise a plurality of plates sealably joined together by impervious sheet materials.

8. An irrigation channel gate as in claim 1 wherein the gate member support frame for both the upstream and downstream gate members comprises a series of frame members and having stretched therebetween impervious flexible sheet material to provide the gate member.

9. An irrigation channel gate as in claim 1 wherein the gate member support frame for the upstream gate comprises a series of frame members having stretched therebetween impervious flexible sheet material to provide the gate member.

10. An irrigation channel gate as in claim 8 wherein the series of frame members comprises a base frame hinged to a base of the central frame and two side frames, one to each side of the base frame and hinged to the central frame, with the side frames adapted to swing inwards and the base frame adapted to swing upward.

11. An irrigation channel gate as in claim 10, further including a link arm between the side frame and the base frame.

12. An irrigation channel gate as in claim 1 wherein the gate member support frame for the downstream gate comprises a single transverse bar to an impervious flexible sheet material to provide the gate member.

* * * * *